US010016065B1

(12) United States Patent
Vaishnav

(10) Patent No.: US 10,016,065 B1
(45) Date of Patent: Jul. 10, 2018

(54) PORTABLE ELECTRONIC BABY CHAIR/HIGHCHAIR

(71) Applicant: Himanshu Vaishnav, Campbell, CA (US)

(72) Inventor: Himanshu Vaishnav, Campbell, CA (US)

( * ) Notice: Subject to any disclaimer, the term of this patent is extended or adjusted under 35 U.S.C. 154(b) by 0 days.

(21) Appl. No.: 15/494,750

(22) Filed: Apr. 24, 2017

(51) Int. Cl.
*A47D 15/00* (2006.01)
*A47D 1/10* (2006.01)
*A47D 13/02* (2006.01)
*A47D 1/00* (2006.01)

(52) U.S. Cl.
CPC ..... *A47D 1/10* (2013.01); *A47D 1/006* (2013.01); *A47D 13/025* (2013.01)

(58) Field of Classification Search
CPC ..... A47D 1/10; A47D 1/006; A47D 1/106; A47D 1/002; A47D 1/004; A47D 13/025
USPC ..... 297/130, 134, 135, 174 CS
See application file for complete search history.

(56) References Cited

U.S. PATENT DOCUMENTS 2,667,207 A * 1/1954 Magyar ..... A47D 1/004 108/11
4,629,247 A 12/1986 Wu
4,863,216 A 9/1989 Prescott
5,415,456 A 5/1995 Hart et al.
5,470,127 A 11/1995 Kassai et al.
5,480,211 A 1/1996 Douglas et al.
6,241,313 B1 * 6/2001 Lenz ..... A47D 1/10 297/188.06
6,273,503 B1 * 8/2001 Cheng ..... A47D 1/106 297/135
6,679,549 B2 * 1/2004 Catelli ..... A47D 1/106 297/174 CS
6,736,451 B1 5/2004 Chen
8,678,491 B2 * 3/2014 Chen ..... A47D 1/106 297/134
2008/0296938 A1 * 12/2008 Flannery ..... A47D 1/106 297/174 CS
2009/0243349 A1 * 10/2009 Flannery ..... A47D 1/106 297/174 CS
2009/0273217 A1 * 11/2009 Flannery ..... A47D 1/106 297/272.1
2010/0038936 A1 * 2/2010 Gibson ..... A47D 1/106 297/174 CS (Continued)

*Primary Examiner* — Mark R Wendell
(74) *Attorney, Agent, or Firm* — Harpman & Harpman

(57) ABSTRACT

A portable multi-functional infant chair and auto adjustment mounting system can be seen as the primary form of the invention. A lightweight adaptable baby chair and support frame having a pair of linked interlocking electro-mechanical adjustment C-clamps. The adjustable C-clamps have self-contained internal electrical activation mechanical clamp plungers for adjustably engaging a stationary support surface securely clamping the baby chair assembly thereto. Confirmation and warning alert system including mobile telemetric network application indicates the clamping and chair position relationship status on the fixed support surface by sensor directed multiple indicators in real time. An internal rechargeable power source is provided to accommodate mobile use parameters. A collapsible independent infant chair stand for independent support of the infant chair and a combination backpack wheel transport for storage of the infant chair and infant chair stand.

11 Claims, 13 Drawing Sheets

(56) References Cited

U.S. PATENT DOCUMENTS

2012/0119460 A1* 5/2012 Zehfuss ..... A47D 1/106
280/47.38

* cited by examiner

PORTABLE ELECTRONIC BABY CHAIR/HIGHCHAIR

This application claims the benefit of U.S. Provisional Application No. 62/328,710, filed Apr. 28, 2016.

BACKGROUND OF THE INVENTION

1. Technical Field

This invention relates to clamping and support devices for infant chairs and the like.

2. Description of Prior Art

Prior art devices of this type can be seen, for example, in U.S. Pat. Nos. 4,629,247, 4,863,216, 5,480,211, 5,470,127, 5,415,456 and 6,736,451.

All of these prior art patents show a variety of similar chair support clamps and attachments for baby highchairs. They all use a basic pivoted engagement lever configuration defined by a generally fixed top extending engagement frame with a pivoted pair of arm extensions defining a clamping action there between on the engaged support surface such as a table edge there between.

SUMMARY OF THE INVENTION

A self-contained portable baby chair and support system having a support frame and fabric cover strap assembly with removable interlocking self-adjusting electro-mechanical activated clamps for selectively secure engagement onto a remote fixed support surface. A purpose-built storage and transport container adaptively holds the baby chair assembly and support clamps enabled frame as well as the optional collapsible high chair support stand and an interengageable purpose built baby carrier as well as affording auxiliary baby related storage item capacity. The transport carrier is configured as a backpack in this example allowing the baby carrier to be selectively attached thereto during use. Alternate configurations as a compact handle enabled wheel carrier with an independent parent engageable attachment baby carrier in a sling configuration as well as manual adjustable clamps.

DETAILED DESCRIPTION OF THE INVENTION

Figure 1:
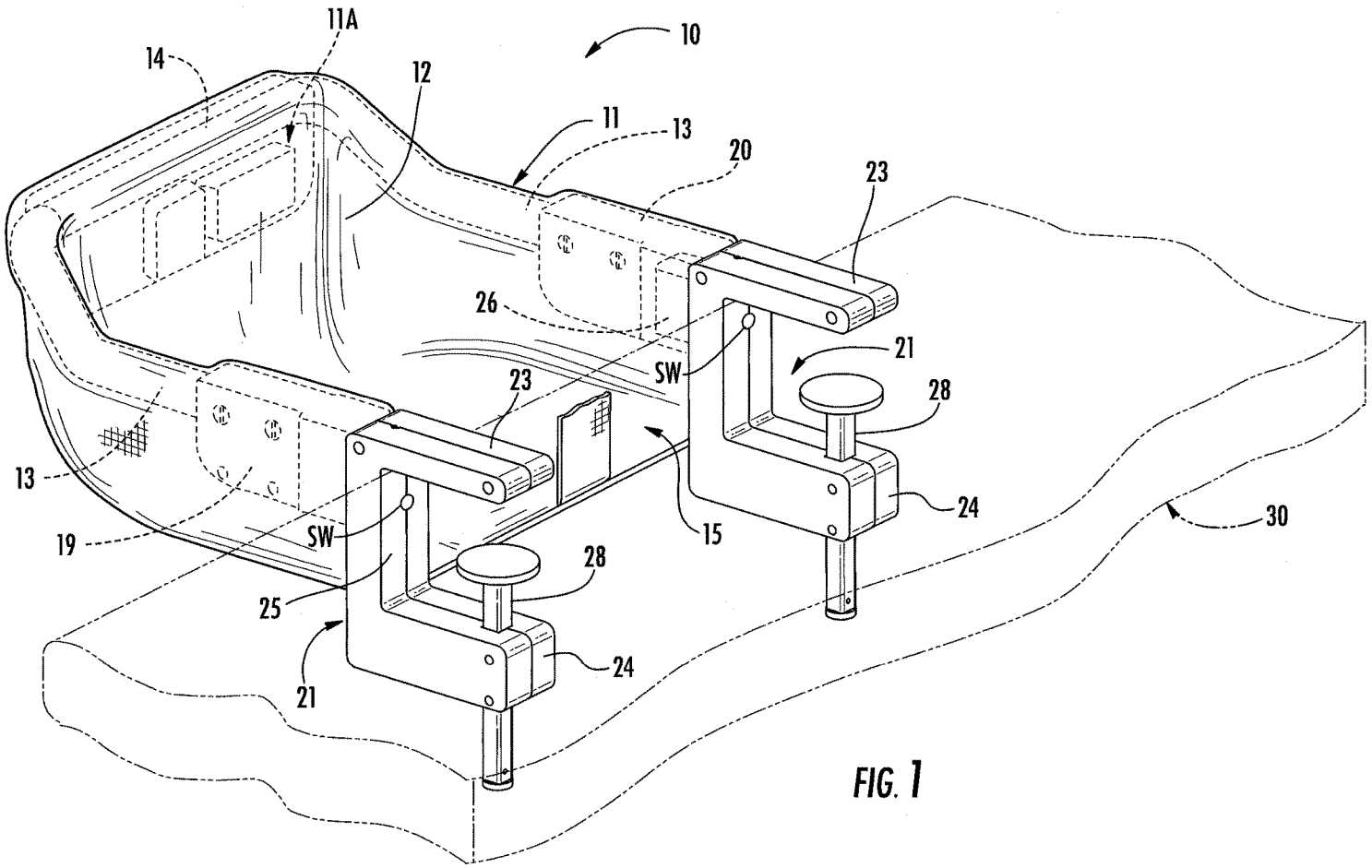
FIG. 1 is a perspective view of the baby chair and auto adjusting clamping system of the invention.
Figure 2:
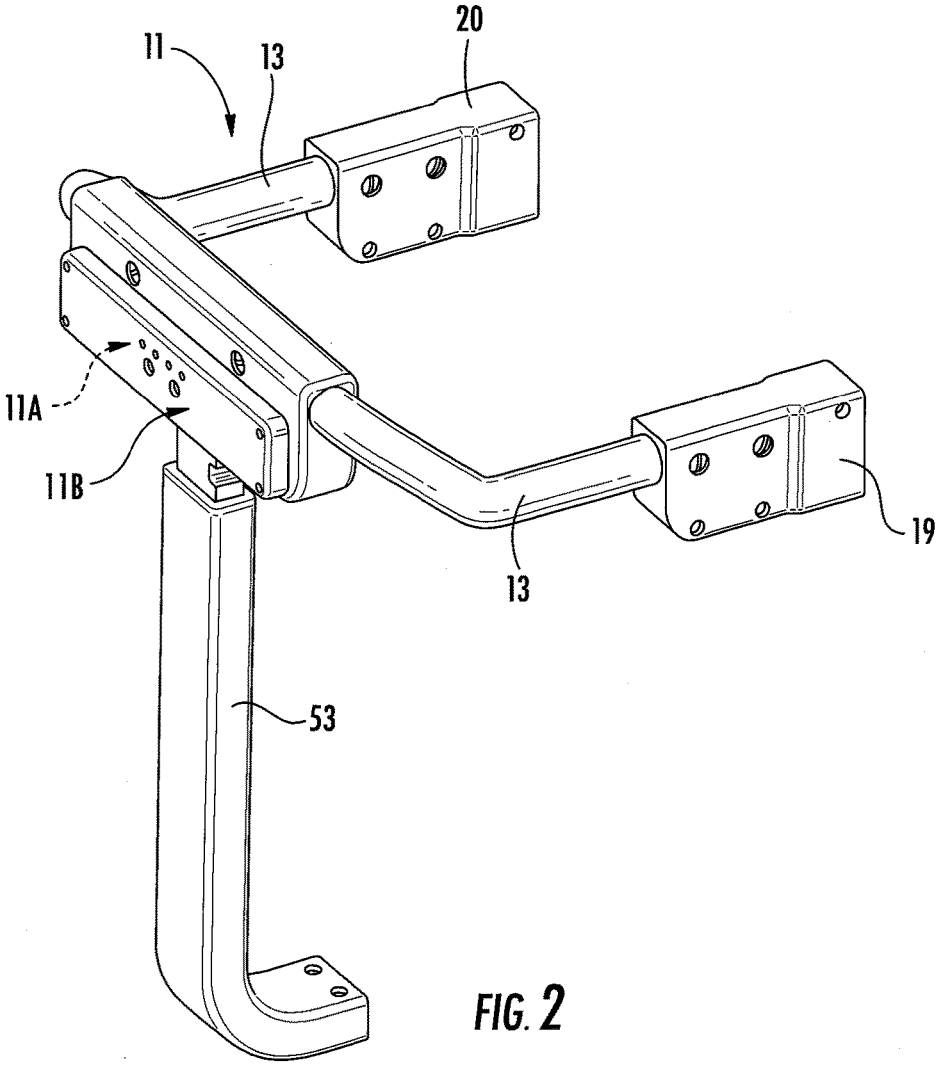
FIG. 2 is an enlarged perspective view of the baby chair frame.

Referring to FIGS. 1 and 2 of the drawings, an electronic adjustable baby chair 10 can be seen having a rigid tubular support perimeter edge frame element 11 with a fabric contoured depending detachable seat assembly 12 shown in broken lines. The frame element 11 is U-shaped tube having oppositely disposed spaced tubular side rails 13 and an interconnecting contoured tubular back rail 14 defining thereby a baby access opening at 15.

Figure 12:
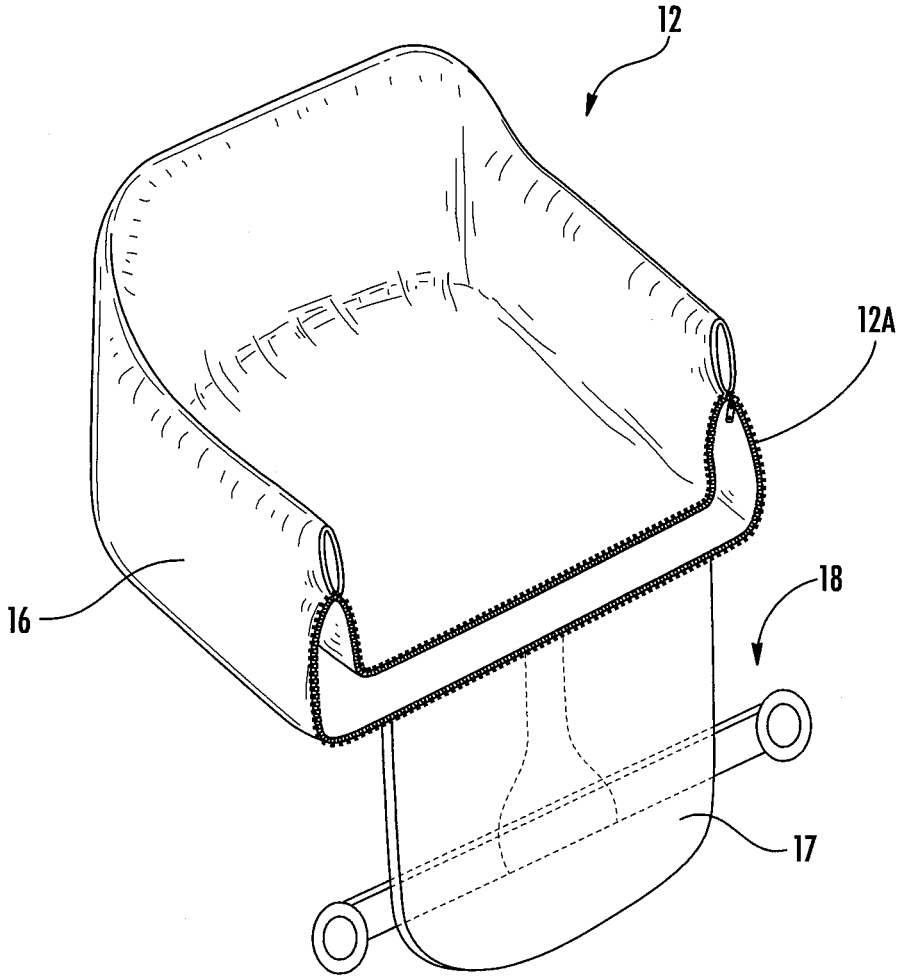
FIG. 12 is a perspective view of a baby chair fabric cover and restraint straps in open position for the baby chair.
Figure 13:
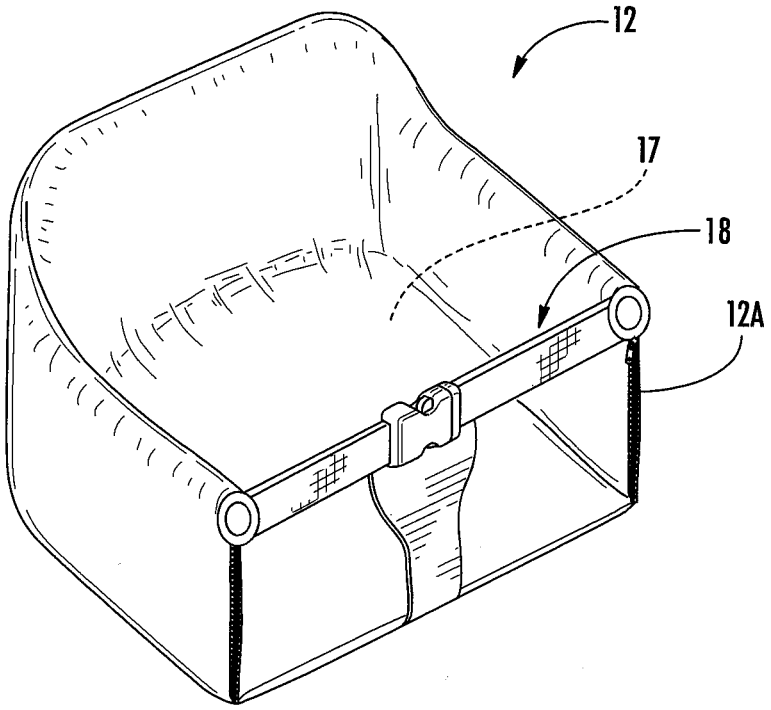
FIG. 13 is a perspective view thereof in closed baby strap engagement position independent of the baby chair.

The detachable fabric seat assembly 12 is removably secured via fasteners, specifically zippers 12A in this configuration to the frame 11 having an integral wrap around flexible sidewall and integral seat 16 when deployed and a hinged cushioned rigid seat base 17 again defining a baby access opening corresponding to the frame element 11, as best seen in FIGS. 1, 12 and 13 of the drawings.

A baby engagement and retainment strap assembly 18 integral therewith extends from the seat assembly 12 assuring that the infant, not shown, is secured within.

The frame 11 has a pair of integral mount locking mechanisms 19 and 20 on the respective free ends of the side rails 13 as best seen in FIG. 2 of the drawings. The locking mechanisms 19 and 20 have a female engagement fitting openings with electrical contacts for registration of respective electro-mechanical clamps 21 with a sensor SW as will be described in greater detail hereinafter.

The frame element 11 has a rechargeable battery, an electronic controller 11A, with LED's and buttons 11B in communication with the sensors SW and electro-mechanical clamps 21. The controller is characterized by a custom proprietary electronic circuitry for activated control management of the chair's components as will be disclosed hereinafter.

Figure 3:
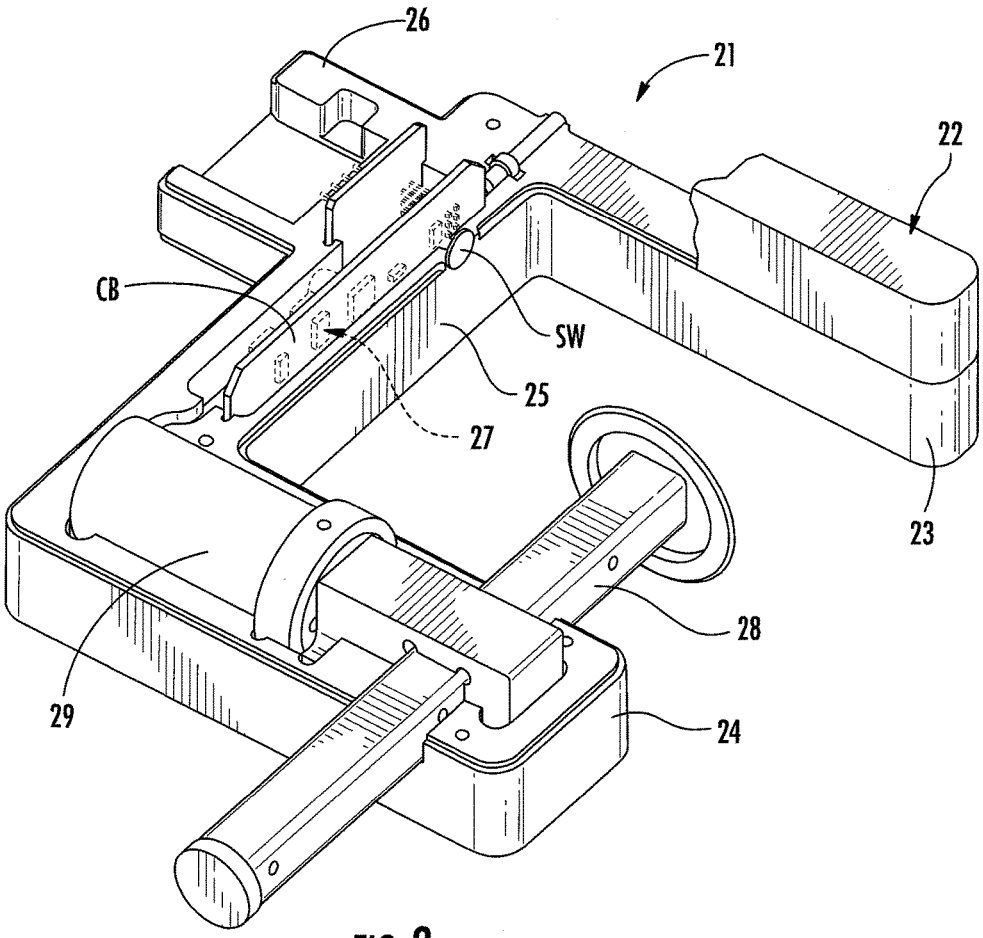
FIG. 3 is an enlarged perspective view, with portions broken away, of the electronically enabled electro-magnetic auto adjustable clamps.

The electro-mechanical clamps 21, best seen in FIG. 3 of the drawings are of a C-clamp configuration with a U-shaped split housing 22 having vertical spaced parallel arms 23 and 24 extending from an interconnecting portion 25. A frame interlocking mounting and communication support fitting 26 extends integrally outwardly from the interconnecting portion 25 adjacent the junction with the respective arm 23. The housing 22 contains electronic components 27 including sensors SW with a proprietary circuitry and a printed circuit board CB there within in this example.

The opposing arm 24 has an extensible plunger element 28 driven by electro-mechanical engagement unit 29 responsive to automatic control inputs from the controller and user manual activation via buttons 11B on the electronic controller 11A.

Automated control inputs for the controller are in response to sensors SW to adjust and maintain the stabilization of the clamps 21 engagement with a fixed contact support surface 30 such as a table shown in broken lines for illustrative purposes only in FIG. 1 of the drawings.

It will be evident that the controller will also indicate chair attachment status by audio and visual indicators, warnings and alarms both localized on the chair assembly or remotely via a telecommunication network and access software applications on portable telecommunication devices, such as smart phones.

Figure 6:
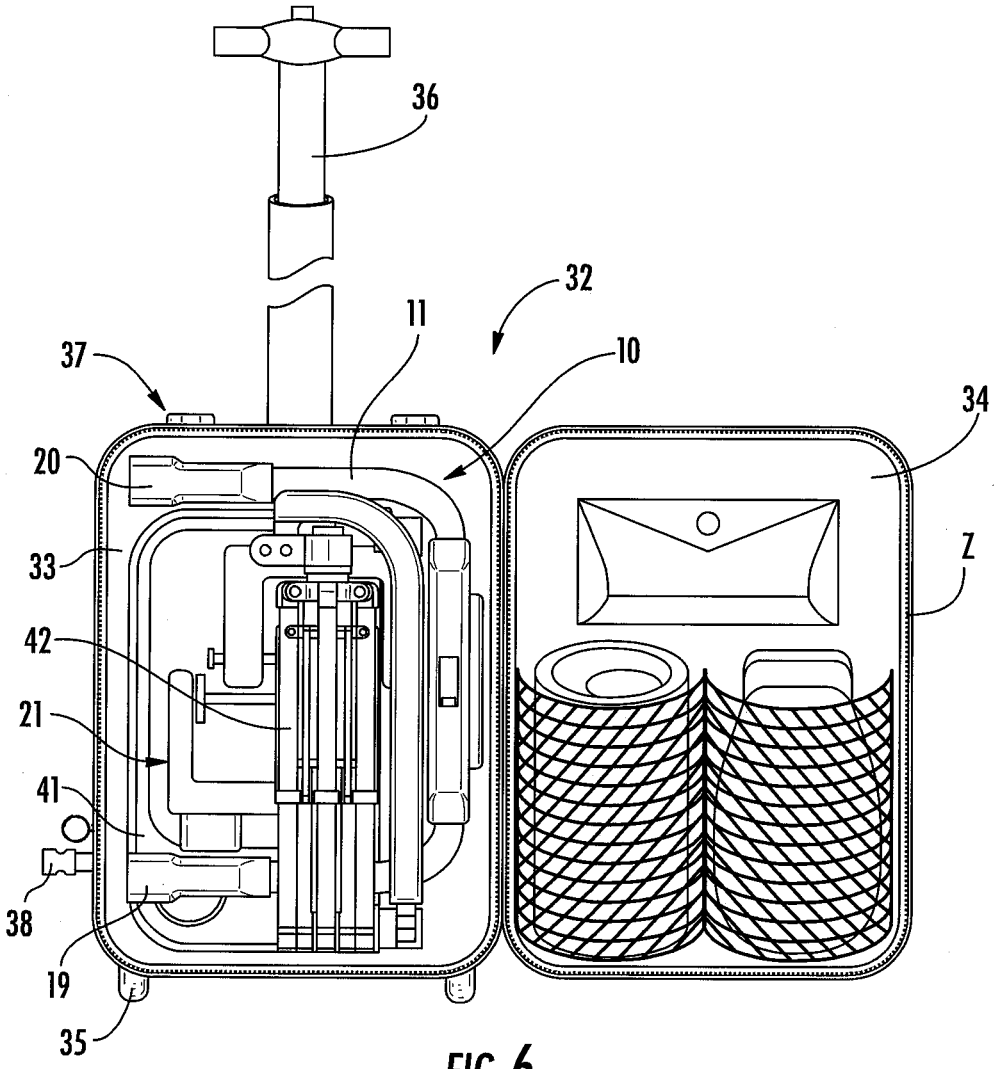
FIG. 6 is a front perspective view of chair backpack transport and storage roll away container with an extensible handle in open access position.
Figure 7:
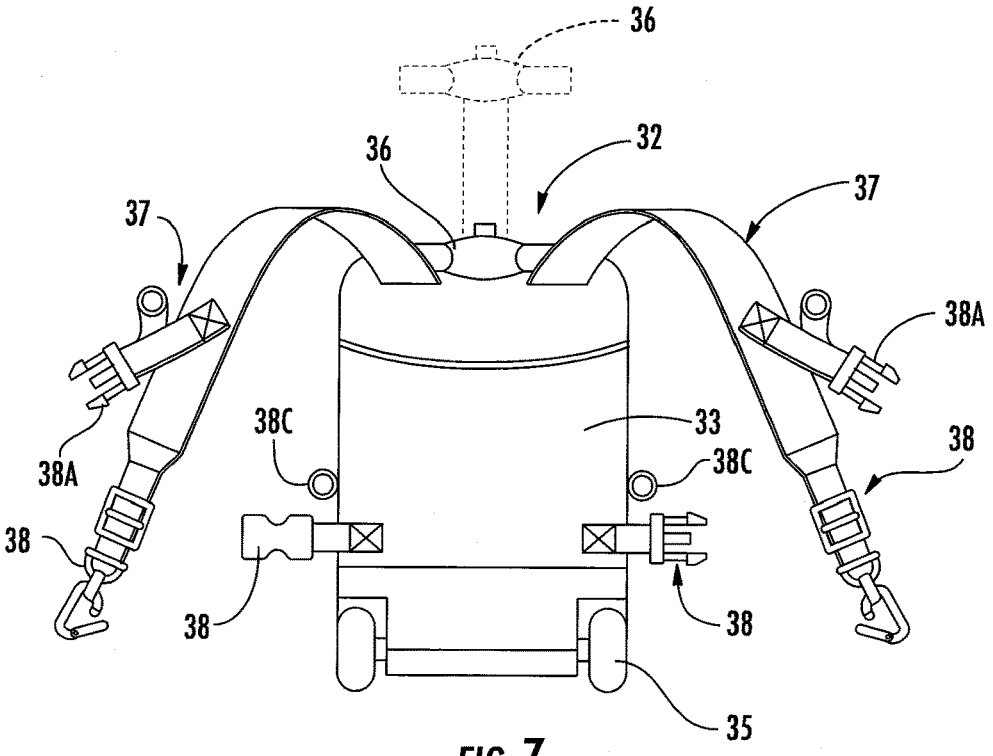
FIG. 7 is a rear perspective view of the chair backpack transport and storage rollaway container with integral wheels and extensible handle engagement assembly in closed position.
Figure 8:
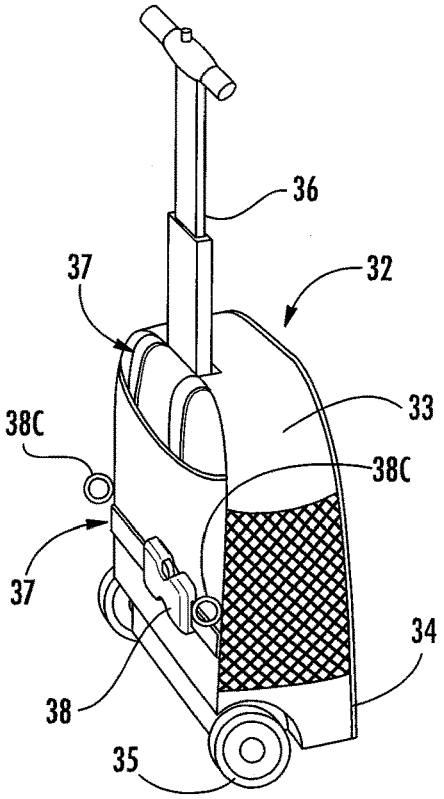
FIG. 8 is a side and rear perspective view thereof.

Referring now to FIGS. 6, 7 and 8 of the drawings, a storage and transport container can be seen configured as a backpack 32 having a custom interior configuration with a main enclosure body member 33 with a zippered access and storage panel 34, wheels 35 on the backpack base with a collapsible handle 36 extending from the top allows for wheel transport. User support straps and belt assemblies 37 extend from the body member 33 with multiple auxiliary attachment buckles and snap fittings 38 and 38A extending from the straps and belt assemblies 37 for selective attachment with the backpack rings 38C and an independent attachable baby carrier construction respectively as illustrated in FIG. 14 of the drawings with baby 40 on a person P.

Figure 4:
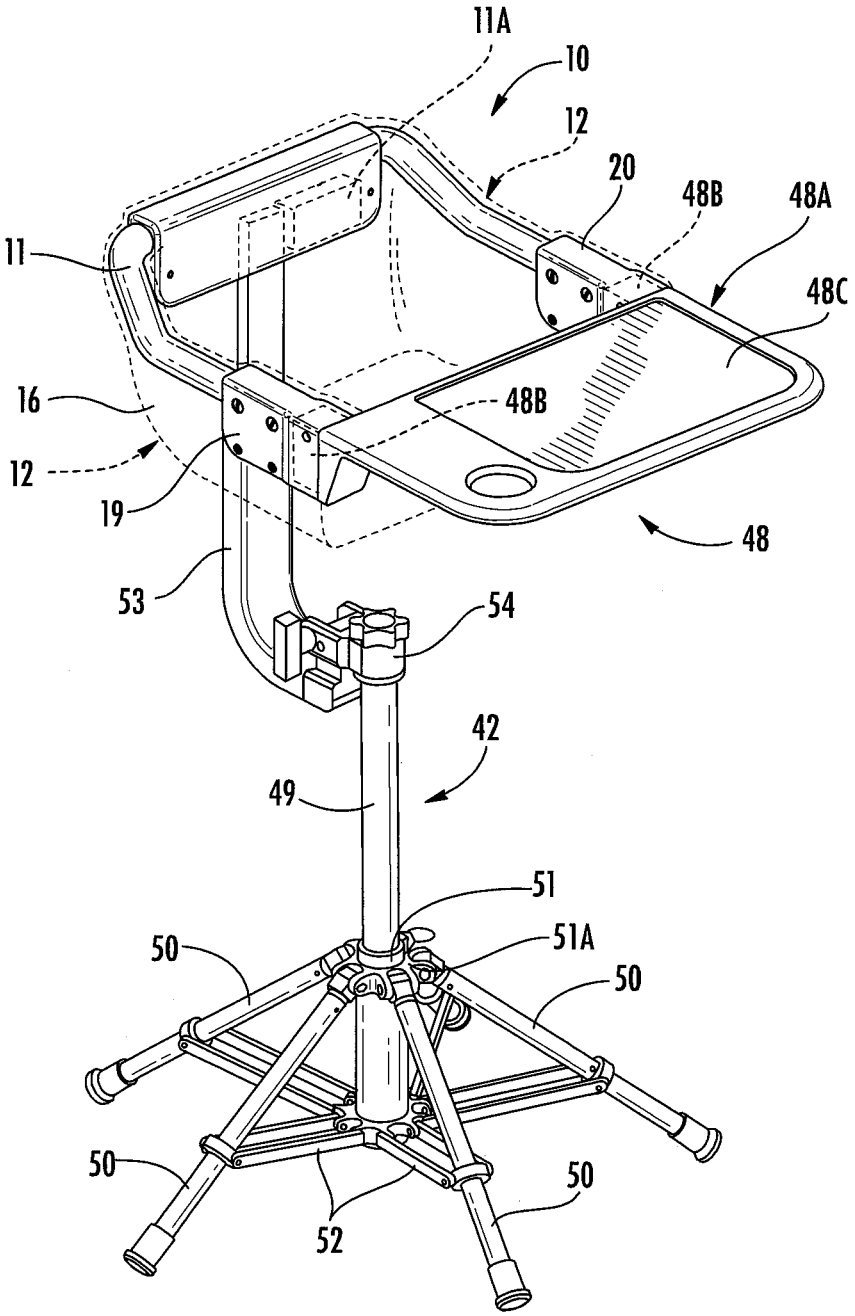
FIG. 4 is a perspective view of a ground engageable adjustable support stand for the baby chair with chair attached.

The enclosed body member 33 provides storage for the baby chair 10 and C-clamps 21 as well as a baby carrier 41 disclosed hereinafter. Additionally, a collapsible baby chair stand 42 can be stored which will effectively convert the baby chair 10 to a stand-alone highchair configuration 43 as seen in FIG. 4 of the drawings. Other infant associated items can also be stored for easy access such as diapers, baby wipes and other accessories, not shown, as will be well understood by those skilled in the art.

Figure 14:
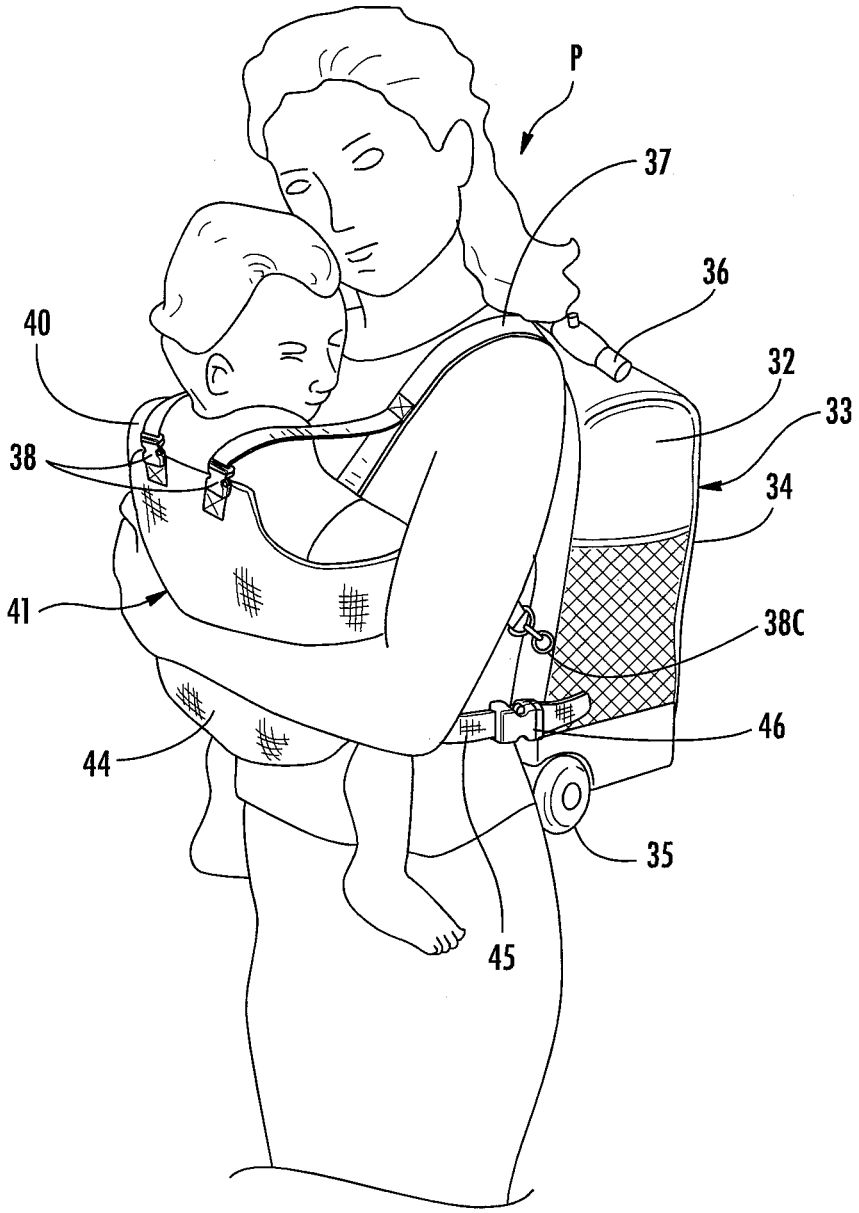
FIG. 14 is a perspective view of a baby carrier and chair transport container backpack in use on a person.

Referring now to FIG. 14 of the drawings, the baby carrier 41 can be seen having a primary flexible baby engagement surface portion 44 with integrated leg openings, not shown, and lower attachment straps 45 of the baby carrier with oppositely disposed male and female attachment buckles 46 of the backpack 32 on their respective free ends.

To place the transport backpack 32 on the back of person P, a pair of padded shoulder straps 37 extend from the backpack transport 32 around the shoulders of a person P to attach to the metallic rings 38C on the lower part of the transport 32 independently as will be understood by those skilled in the art. In alternate use configuration, a person P can carry a baby in a baby carrier wrapped around a person P, pull collapsible handle 36 out and roll the backpack transport 32 by hand on the ground.

Referring now to FIG. 4 of the drawings, the collapsible baby chair stand 42 can be seen with the baby chair 10 positioned thereon defining a stand-alone self-supporting highchair 48. The collapsible baby chair stand 42 is but one example of a multiple leg support assembly and the disclosure therefore is not limited by inclusion therewith. The collapsible stand 42 has a central cylinder member 49 with the highchair height adjustment mechanism that can be locked in position with the fitting 51 and multiple telescopically extensible adjustable legs 50 pivotally secured to a central annular engagement fitting 51A which is slidably disposed on the cylinder member 49. Corresponding pivoted leg support rods 52 extend from the bottom of the cylinder 49 to the respective adjustable legs 50 providing for a well understood leg deployment for highchair stability and relative height adjustment mechanism as needed.

Figure 5:
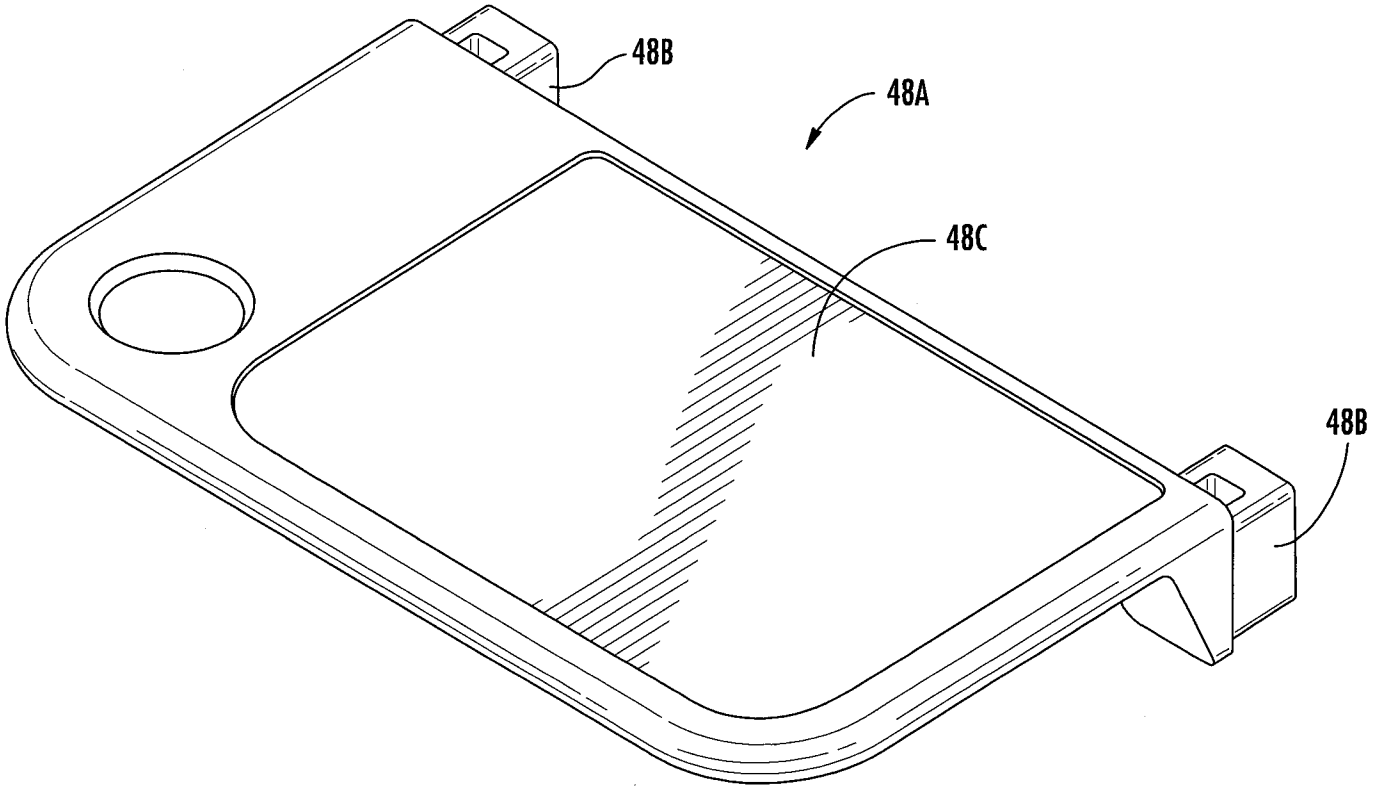
FIG. 5 is a perspective view of a tray for the baby chair.

A foldable support arm 53 extends from the rotatable mounting fitting 54 to the chair 10 to secure to the collapsible stand 42's cylinder member 49. A tray assembly 48A, best seen in FIG. 5 of the drawings has a pair of insert fittings 48B extending from a tray 48C for registration with the hereinbefore described locking mechanisms 19 and 20 replacing the clamps 21 for the highchair application.

Figure 9:
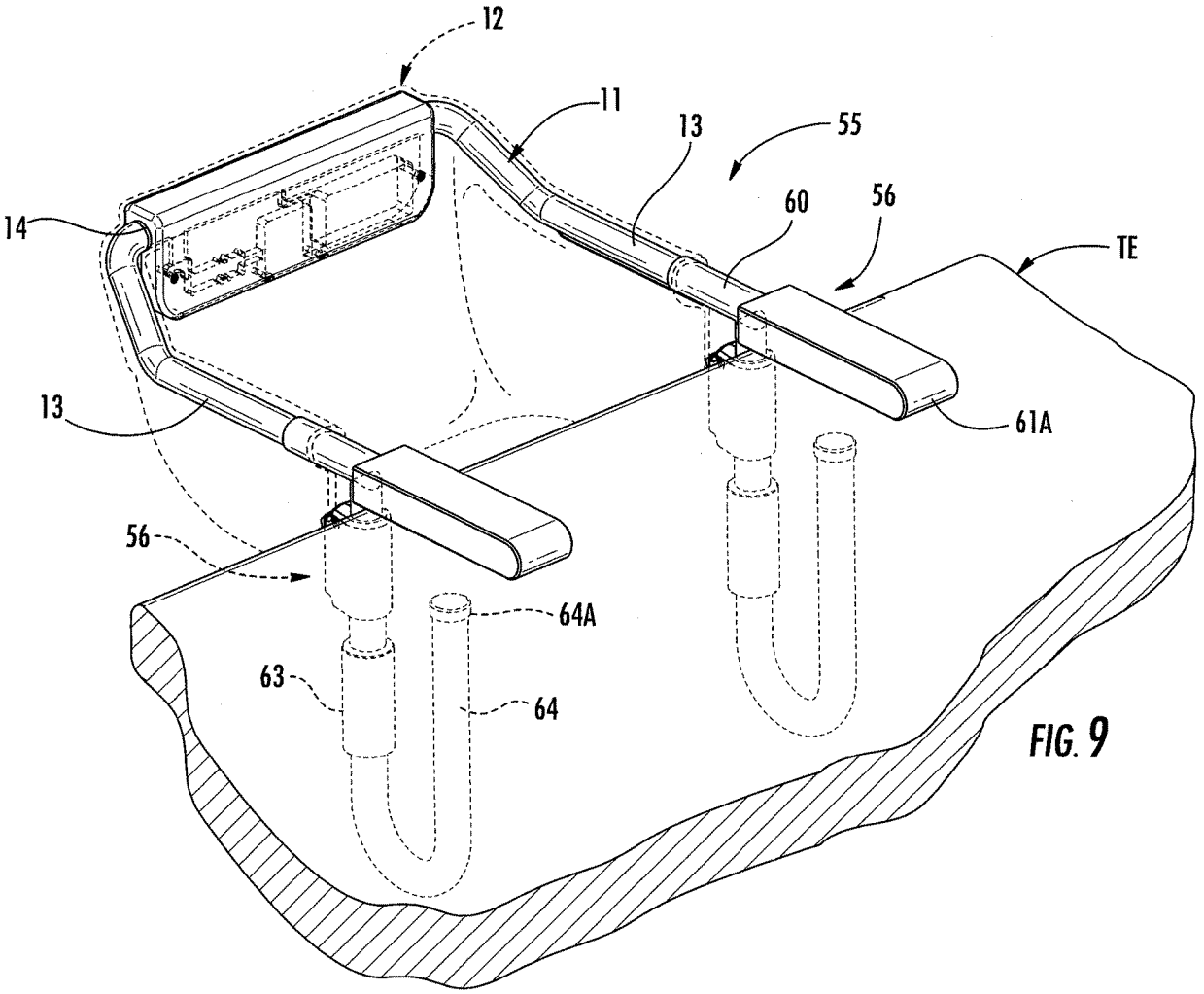
FIG. 9 is a front perspective view of an alternate baby chair with manually adjusting clamping system.
Figure 10:
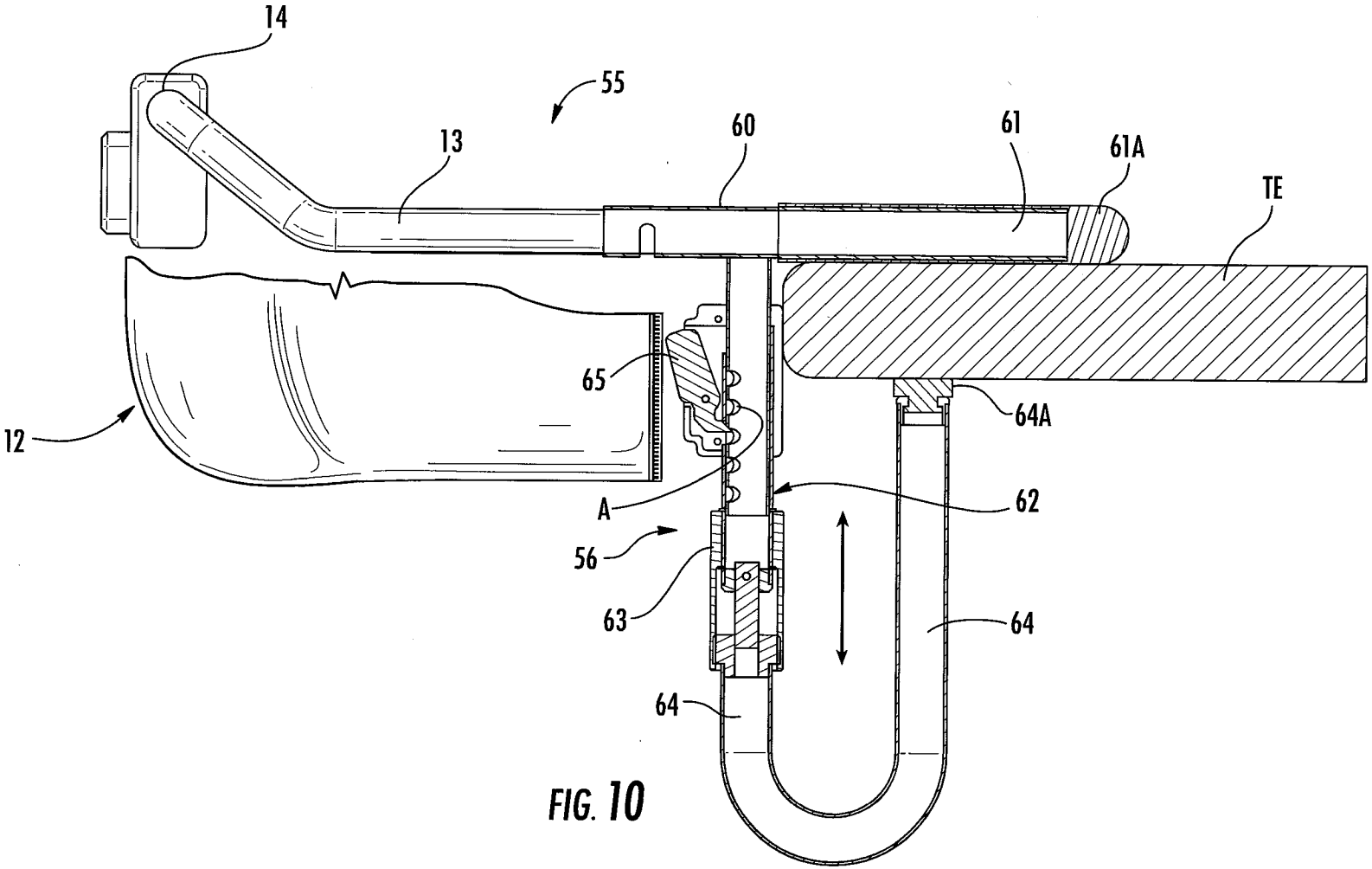
FIG. 10 is a side elevational view thereof with portions broken away.
Figure 11:
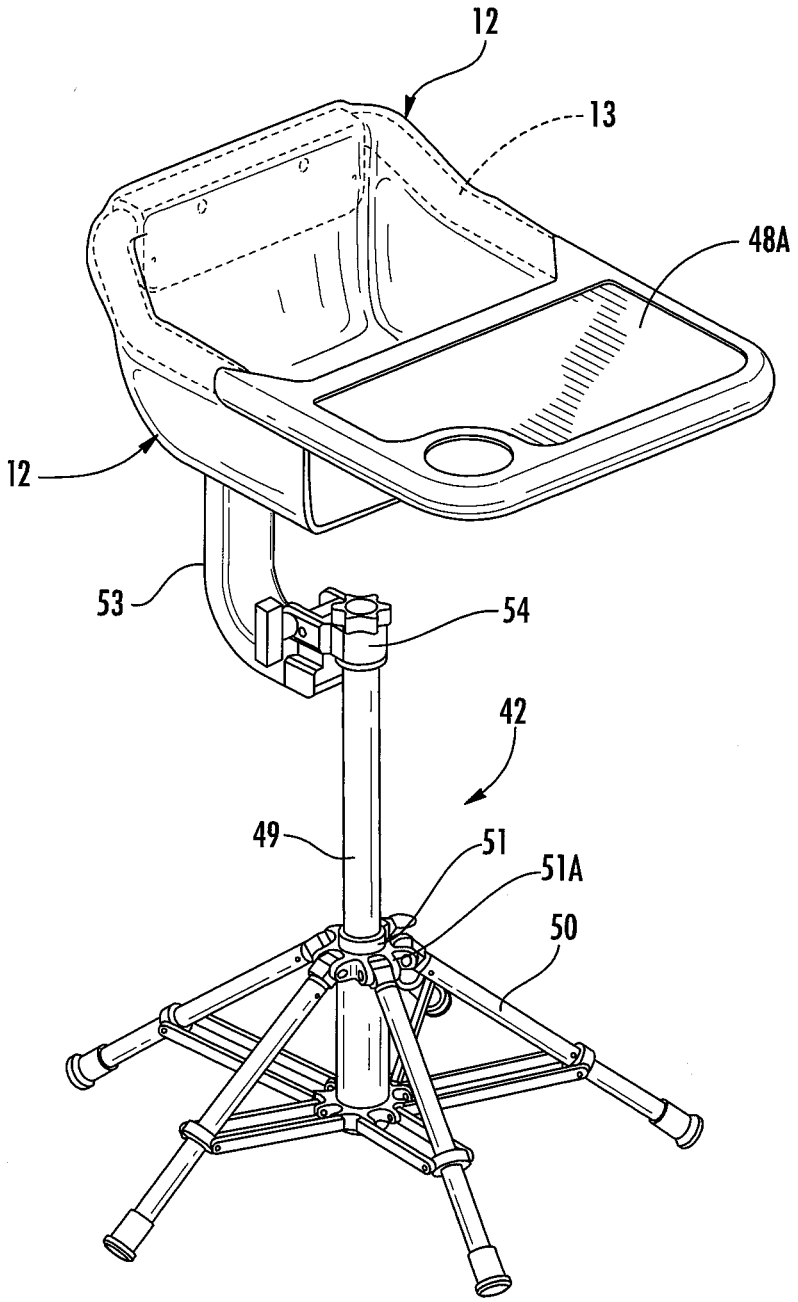
FIG. 11 is a perspective view of the alternate baby chair on a collapsible highchair stand.

Referring now to FIGS. 9, 10, and 11 of the drawings, an alternate baby chair clamping system 55 can be seen having electronics depopulated manually adjustable C clamp assemblies 56. The manual C clamp assemblies 56 are positioned on the respective ends of a U-shaped baby chair frame 11 having oppositely disposed tubular side rails 13 and an interconnected tubular back rail 14 defining thereby a baby access opening 15.

Each of the manual adjusting chair assemblies 56 has a tubular frame engagement end fitting 60 with a longitudinally extending upper table engagement arm 61 and an end cover 61A with a tube assembly 62 for a selectively secure engagement of the baby chair onto a remote fixed support surface.

An adjustable engagement sleeve 63 extends over and interconnects with a corresponding return bottom bracket 64 in spaced vertical alignment with the engagement arm 61 for fine turning end surface engagement with, and desired tightening of the clamps to the bottom of the table edge TE.

The adjustable indexing tubular assembly 62 has a plurality of longitudinally aligned indexing apertures A with a pivoted arm engagement lever 65. By indexing advancement thereof, the bracket 64 can be advanced vertically on the fixed index tube 62 and thereby coarsely engageable against the bottom of the table edge TE between the upper table engagement arm 61 in a clamping retainment action securing the alternate baby chair clamping system 55 thereto as best seen in FIGS. 9 and 10 of the drawings.

Referring to FIG. 11 of the drawings, the baby seat frame 11 with fabric seat 12 insert, as described, can be seen independently used on the hereinbefore described collapsible highchair stand 42 with, in this example, an attached tray 48A.

In use, the baby chair 10 of the invention is retrieved from the selective wheeled backpack transport container 32 sequentially assembled, as noted, and clamped on the edge of the stationary support surface 30 which is confirmed by the inclusive sensors SW of the system with an auditory or visual signal or manually with the hereinbefore described clamping assemblies 56.

The automatic electro-mechanical C clamps 21 will activate and advance the respective plungers 28 thereby securing the baby chair assembly 10 to the attachment surface.

The infant support seat assembly 12 defined by the hinged rigid seat base 17 and cushion with the integrated flexible sidewall 16 and a strap assembly 18 as seen in FIG. 12 of the drawings in open in pre-installation position with a frame access opening with the perimeter zipper closure 12A and in FIG. 13 of the drawings slidably engaged on the respective baby seat support frame 11, not shown. It will be evident from the above description that a baby chair tray 48A as seen in FIG. 4 of the drawings may be adaptably secured thereto in either the attached chair configuration 10 or in the stand-alone highchair 42 configuration previously described depending on the user's needs and requirements in the application chosen for deployment.

It will be seen that the attached baby chair 10 of the invention is now monitored for movement via the indicated sensors SW and if detected a warning is given locally on the chair assembly 10 and/or remotely through an electronic component 27 including a telecommunications network TN to a smart phone application, not shown.

The electro-mechanical C-mounts 21 will independently re-engage upon detected movement as interpreted by the controller which may be based on a predetermined threshold and activated to re-tighten the electromagnetic clamps 21 to assure a safe, stable chair attachment is maintained.

Manual release and activation buttons 11B are provided which allow for the direct user engagement and/or release thereof and removal of the chair and/or clamps as desired from the original point of attachment, if required.

Separate control elements on the frame 11 provide for manual C-clamp 21 and frame 11 separation and removal for storage and transport, as noted.

A battery monitoring circuit as part of the proprietary circuit of the system will determine the battery charge status and indicate the requirement for recharging as well as battery failure with an automated fault indicator alerting the user thereto. A manual override release is provided in this application for chair release should the system fail, as noted above.

Confirmation of support arm 53 hinged to highchair support stand 42 when in full upright and locked position is provided by the locking mechanism in rotatable mounting fitting 54. Confirmation of assembly of the chair 10 to the support arm 53 in full upright position is provided in the rear element 14 of the frame 11 once the legs 50 are adjustably positioned with proper elevation support requirement.

It will thus be seen that the portable auto electronic baby chair/highchair or manual engagement can be used in multiple configurations and can be easily stored and transported in a container configured as a wheeled backpack 32 and storage device which is a wheeled enclosure having fixed or swivel wheel 35 configurations and a telescopically extensible handle assembly 36 for ease of engagement and transportation. The baby carrier 41 can be used, as noted, either in connection with the backpack storage and transport 32 as seen in FIG. 14 of the drawings or independently, not shown, in which it can be easily secured to the user for use.

It will be evident from the above description that various changes and modifications may be made thereto without departing from the spirit of invention.

Therefore, I claim:

1. A self-adjusting infant chair for attachment to an elevated support surface, said infant chair comprises in combination:

a U-shaped chair frame;

a detachable flexible seat secured to said chair frame;

a pair of adjustable support surface clamps removably secured to said chair frame;

a controller and source of power in communication with said support surface clamps;

means for independent adjusting of said support surface clamps engagement against said elevated support surface;

a collapsible infant chair stand for support of said infant chair independent of said support surface clamps;

means for storing and transporting said infant chair and said collapsible chair stand.

2. The self-adjusting infant chair set forth in claim 1 wherein said surface support clamps comprises:

a C-clamp configuration having spaced parallel arms;

an extensible plunger extending from one of said arms in oppositely disposed relation to said remaining arm;

said extensible plunger engageable on a lower surface of said elevated support surface.

3. The self-adjusting infant chair set forth in claim 1 wherein said detachable flexible seat comprises:

a flexible fabric sidewall and seat;

a hinged rigid seat base and a baby restraint strap assembly extending therefrom.

4. The self-adjusting infant chair set forth in claim 1 wherein said controller and source of power comprises:

a microprocessor;

multiple proximity sensors in said support surface clamps;

a rechargeable battery in electrical communication with said adjustable surface support clamps.

5. The self-adjusting infant chair set forth in claim 4 further comprises:

a programmable wireless communication hub, independent interlinked remote control program applications for portable communication devices in communication therewith.

6. The self-adjusting infant chair set forth in claim 1 wherein said collapsible infant chair stand comprises:

a central cylinder;

annular leg fitting on said cylinder;

multiple legs pivotally extending from said annular leg fitting;

a chair mounting brace on an end of said cylinder extending to said chair frame in spaced relation to said annular leg fitting.

7. The self-adjusting infant chair set forth in claim 1 wherein means for storing and transporting said infant chair and collapsible infant chair stand comprises:

a wheeled soft side container having a hinged access closure panel;

an extensible handle assembly on said container;

multiple attachment straps extending from said container for selectively securing said container to a body of a human.

8. The self-adjusting infant chair set forth in claim 1 wherein said means for independent adjusting said support surface clamps comprises:

electro-mechanical drives in communication with support surface clamps and the controller and source of power.

9. The self-adjusting infant chair set forth in claim 1 further comprises:

a chair tray selectively secured to said U-shaped chair frame in place of said support surface clamps.

10. The self-adjusting infant chair set forth in claim 1 wherein said means for independent adjusting said surface engagement clamps further comprises:

manually adjustable indexing tube assembly having multiple aligned indexing apertures therein;

an engagement lever sequentially engaging said indexing apertures longitudinally advancing and retracting a return tube portion for engagement with said elevated support surface.

11. The self-adjusting infant chair set forth in claim 1 further comprises:

a baby carrier having a flexible fabric surface, baby access openings in said fabric surface, and multiple strap attachments extending from said flexible fabric surface.

* * * * *